US007275960B2

(12) United States Patent
Fukushima et al.

(10) Patent No.: US 7,275,960 B2
(45) Date of Patent: Oct. 2, 2007

(54) WIRE HARNESS-SIDE SHIELD CONNECTOR

(75) Inventors: Hirotaka Fukushima, Makinohara (JP); Takuya Endo, Makinohara (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 11/582,499

(22) Filed: Oct. 18, 2006

(65) Prior Publication Data

US 2007/0087621 A1 Apr. 19, 2007

(30) Foreign Application Priority Data

Oct. 18, 2005 (JP) ..... P2005-302890

(51) Int. Cl.
*H01R 9/03* (2006.01)

(52) U.S. Cl. ..... 439/610

(58) Field of Classification Search ..... 439/610, 439/579, 609

See application file for complete search history.

(56) References Cited

U.S. PATENT DOCUMENTS

| | | | | |
|---|---|---|---|---|
| 4,272,148 | A * | 6/1981 | Knack, Jr. | 439/455 |
| 5,244,415 | A * | 9/1993 | Marsilio et al. | 439/610 |
| 5,848,914 | A * | 12/1998 | Lang et al. | 439/610 |
| 5,997,349 | A * | 12/1999 | Yoshioka | 439/579 |
| 2002/0081904 | A1 * | 6/2002 | Ko | 439/610 |
| 2003/0104727 | A1 * | 6/2003 | Chen et al. | 439/610 |
| 2005/0266729 | A1 * | 12/2005 | Fukushima et al. | 439/610 |

* cited by examiner

*Primary Examiner*—Phuong Dinh
(74) *Attorney, Agent, or Firm*—Sughrue Mion, PLLC

(57) ABSTRACT

A wire harness-side shield connector includes an outer case fittingly connected to a unit-side connector and having a shielding function, and a housing receiving connection terminals fixed respectively to end portions of a plurality of shielded wires, wherein the outer case includes a shield shell which receives the housing and has a shielding function, and a shell holder which when fixed to the shield shell by threading a screw member, causes braids of the shielded wires folded back outwardly to be conductively connected to the shield shell.

3 Claims, 9 Drawing Sheets

WIRE HARNESS-SIDE SHIELD CONNECTOR

BACKGROUND OF THE INVENTION

1. Field of the Invention

This invention relates to a wire harness-side shield connector designed to cope with the difference in electromagnetic shield processing (individual shield processing and collective shield processing) from one vehicle (such as a hybrid car) to another.

2. Description of the Related Art

Shield connectors are already known (see, for example, JP-A-2001-60481 Publication (FIG. 1)).

FIG. 11 is a longitudinal cross-sectional view of a wire harness-side shield connector disclosed in JP-A-2001-60481 Publication (FIG. 1).

In the shield connector shown in FIG. 11, a male connector housing 100 includes a tubular hood portion 102 mounted on a connector housing 101, the hood portion 102 being in the form of an electrically-conductive aluminum sleeve. The hood portion 102 is fitted in a mating connector 110, and surrounds metal terminals 103 to function as a shield shell of the male connector 100. The male connector 100 further includes cylindrical springs 104 provided within the hood portion 102, and the cylindrical springs 104 are resiliently contacted respectively with cylindrical shells 112 provided within a housing 111 of the mating connector 110, so that the male connector 100 is grounded for shielding purposes with the mating connector 110.

However, in the above conventional shield connector, the cylindrical shells 112 of the mating connector 110 are provided within the housing 111, and therefore a collective shield braid of a large diameter can not be connected to the connector. Namely, only individual or separate shielded wires can be connected. Therefore, there has been encountered a problem that this shield connector can not cope with the difference in the electromagnetic shield processing (individual shield processing or collective shield processing) from one vehicle to another on which the shield connector is to be mounted.

SUMMARY OF THE INVENTION

It is an object of this invention to provide a wire harness-side shield connector which can easily and positively cope with the difference in the electromagnetic shield processing (individual shield processing or collective shield processing) from one vehicle to another.

1) According to the present invention, there is provided a wire harness-side shield connector comprising an outer case which can be fittingly connected to a unit-side connector and has a shielding function, and a housing receiving connection terminals fixed by press-clamping respectively to end portions of a plurality of shielded wires; characterized in that:

the outer case comprises:

a shield shell which receives the housing and has a shielding function; and a shell holder which when fixed to the shield shell by threading a screw member, causes braids of the shielded wires, folded back outwardly, to be conductively connected to the shield shell.

In this wire harness-side shield connector, the shell holder is fixed to the shield shell by threading the screw member, so that the braid of each shielded wire is conductively connected to the shield shell by an axial force of the screw member. As a result, the braids of the shielded wires are grounded with the shield shell 21, and thus are subjected to individual (or separate) shield processings, respectively.

In the case of effecting a collective shield processing, a collective shield braid is fitted on the shield shell of the wire harness-side shield connector, and then is press-fastened to the shield shell. As a result, the shield shell and the collective shield braid are conductively connected together, thus effecting the collective shield processing.

2) The wire harness-side shield recited in the above Paragraph 1) is characterized in that shield terminals are fixed respectively to outer peripheries of the folded-back braids of the shielded wires in such a manner that the shield terminals are conductively connected respectively to the braids, and when the shell holder is fixed to the shield shell by threading the screw member, the braids of the shielded wires are grounded with the shield shell via the respective shield terminals.

In this wire harness-side shield connector, the shell holder is fixed to the shield shell by threading the screw member, so that the braids of the shielded wires are conductively connected via the respective shield terminals to the shield shell by the axial force of the screw member. As a result, the braids of the shielded wires are grounded with the shield shell via the respective shield terminals, and thus are subjected to individual (or separate) shield processings, respectively.

In the case of effecting the collective shield processing, the collective shield braid is fitted on the shield shell of the wire harness-side shield connector, and then is press-fastened to the shield shell. As a result, the shield shell and the collective shield braid are conductively connected together, thus effecting the collective shield processing.

3) The wire harness-side shield connector recited in the above Paragraph 1) or Paragraph 2) is characterized in that a waterproof packing is fitted on an outer periphery of the housing, and is interposed between the housing and the shield shell, and a waterproof plug is fitted on an outer periphery of that portion of each shielded wire disposed between the connection terminal and the shield terminal, and is interposed between the shielded wire and the housing.

In this wire harness-side shield connector, the waterproof packing secures a waterproof seal between the outer peripheral surface of the housing and an inner peripheral surface of the shield shell. Each waterproof plug secures a waterproof seal between the outer peripheral surface of the shielded wire and an inner surface of the housing. The wire harness-side shield connector has an excellent waterproof performance thanks to the provision of the waterproof packing and the waterproof plugs.

4) The wire harness-side shield recited in any one of the above Paragraphs 1) to 3) is characterized in that a shield ring is mounted on the shield shell of the wire harness-side shield connector when connecting a collective shield braid to the shield shell, and the collective shield braid is fitted on the shield shell, and then the shield ring is fitted on the collective shield ring, thereby press-fastening the collective shield ring to the shield shell.

In the case of effecting the collective shield processing in this wire harness-side shield connector, the collective shield braid is fitted on the shield shell of the wire harness-side shield connector, and further the shield ring is fitted on the collective shield braid. As a result of mounting the shield ring, the collective shield braid is press-fastened to the shield shell in conductively-connected relation thereto, thus effecting the collective shield processing.

In the wire harness-side shield connector of the present invention, the difference in the electromagnetic shield processing (individual shield processing or collective shield processing) from one vehicle to another can be easily and positively coped with.

DESCRIPTION OF THE PREFERRED EMBODIMENTS

A preferred embodiment of the present invention will now be described with reference to the drawings.

Figure 1:
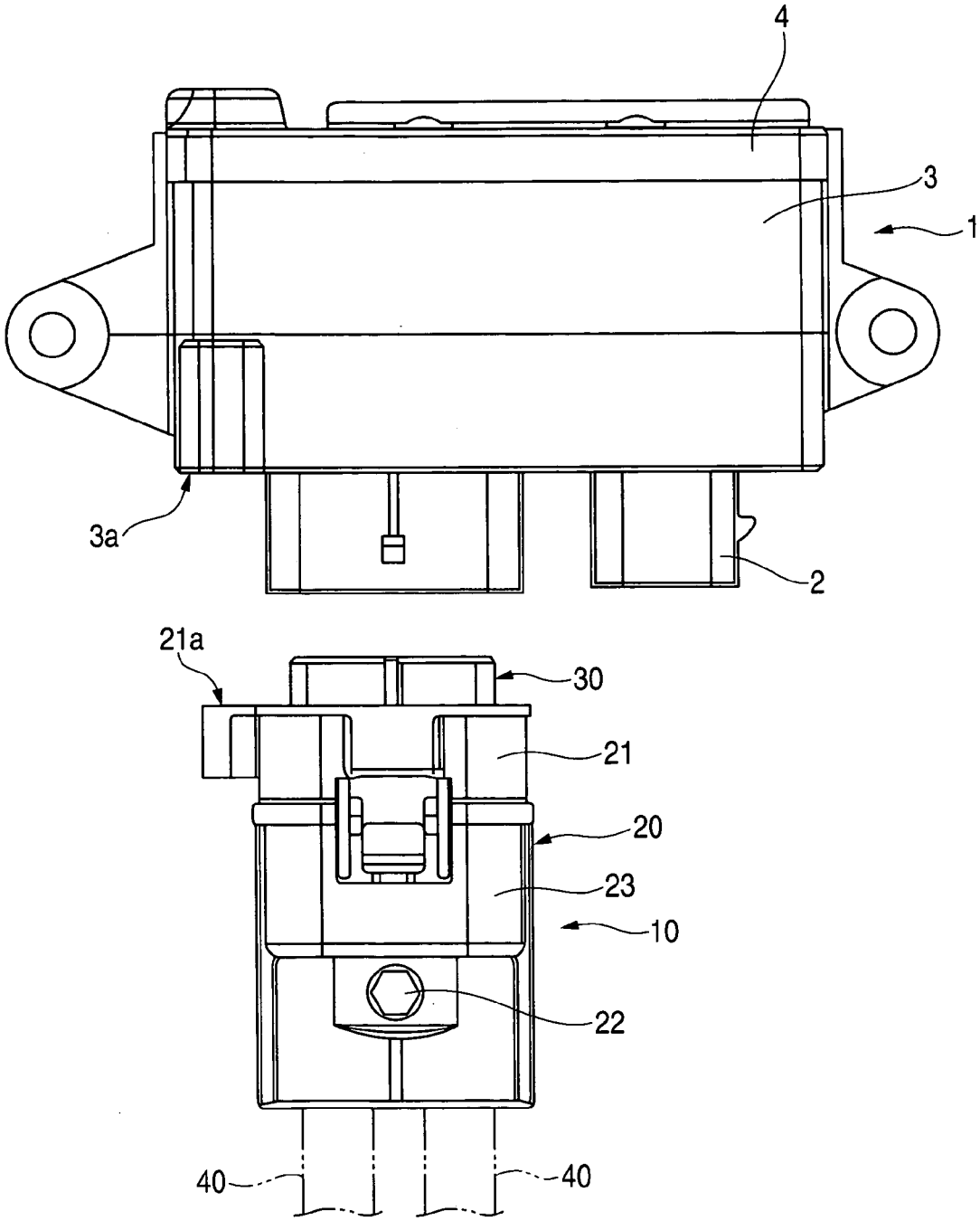
FIG. 1 is a plan view of a shield connector structure employing one preferred embodiment of a wire harness-side shield connector of the present invention.
Figure 2:
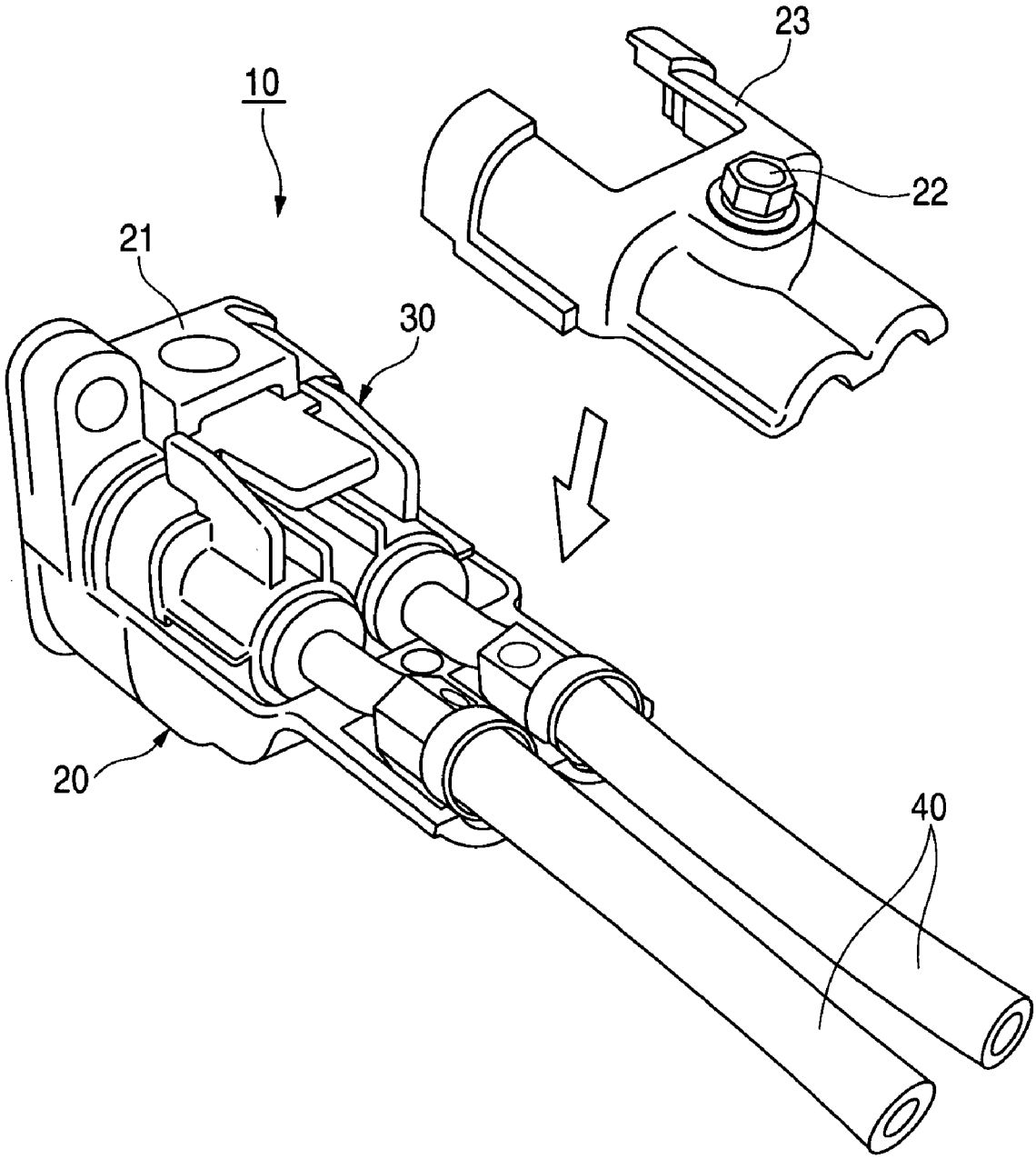
FIG. 2 is an exploded, perspective view of the wire harness-side shield connector of the shield connector structure of FIG. 1.
Figure 3:
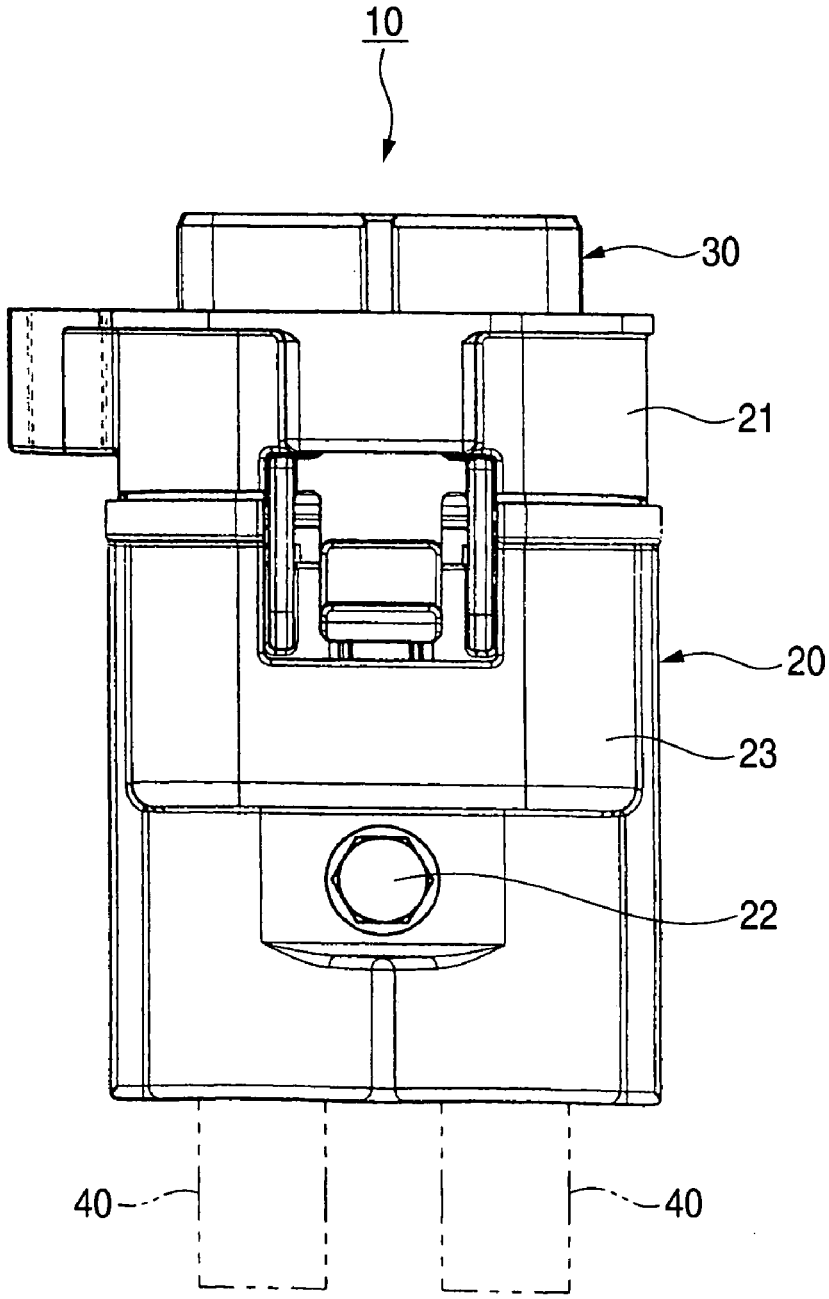
FIG. 3 is a plan view of the wire harness-side shield connector of the shield connector structure of FIG. 1.
Figure 4:
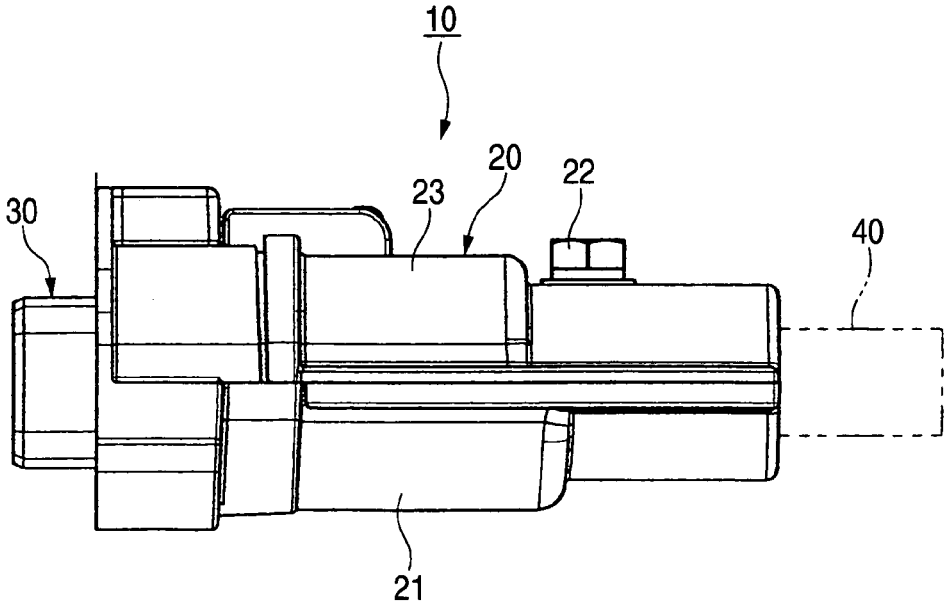
FIG. 4 is a side-elevational view of the wire harness-side shield connector of FIG. 3.
Figure 5:
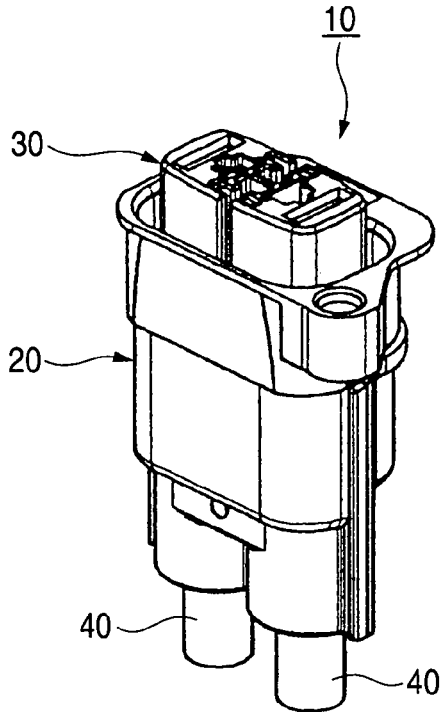
FIG. 5 is a perspective view of the wire harness-side shield connector of FIG. 3.
Figure 6:
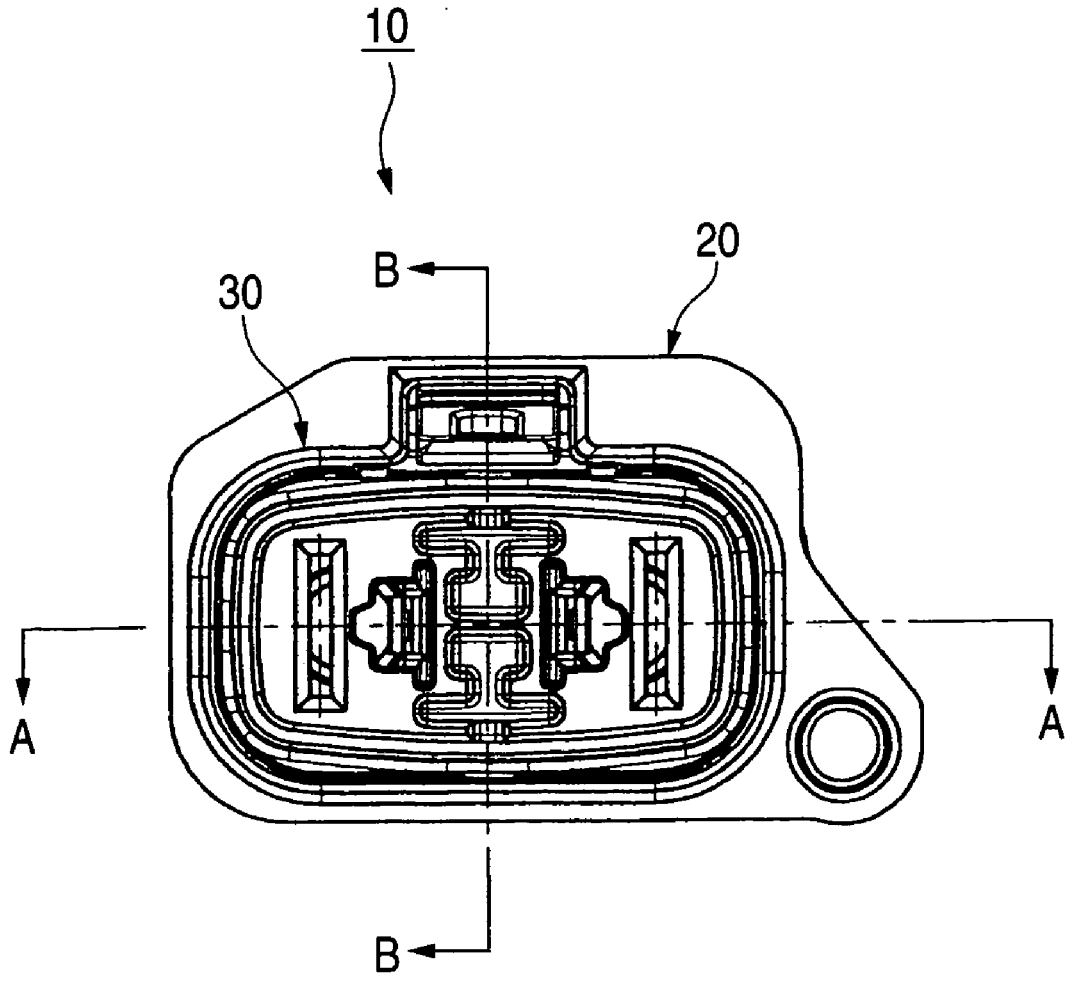
FIG. 6 is a front-elevational view of the wire harness-side shield connector of FIG. 3 as seen from the upper side of FIG. 3.
Figure 7:
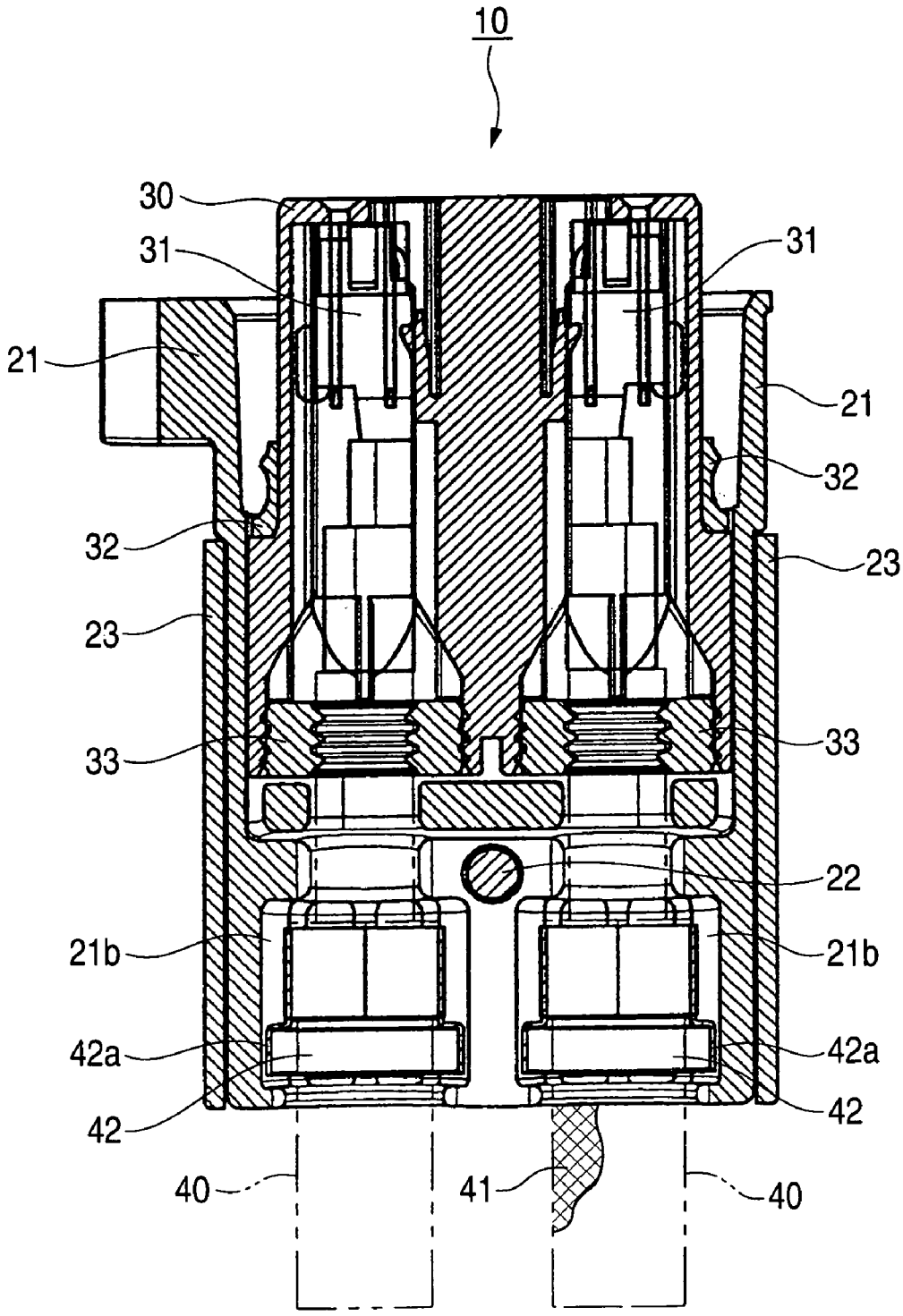
FIG. 7 is a cross-sectional view taken along the line A-A of FIG. 6.
Figure 8:
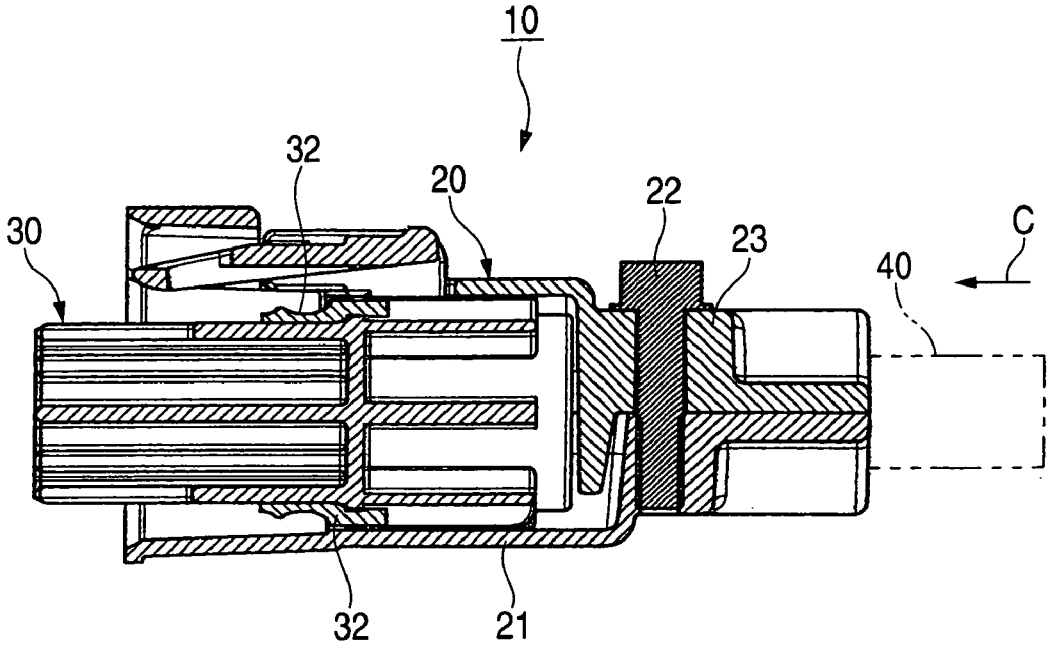
FIG. 8 is a cross-sectional view taken along the line B-B of FIG. 6.
Figure 9:
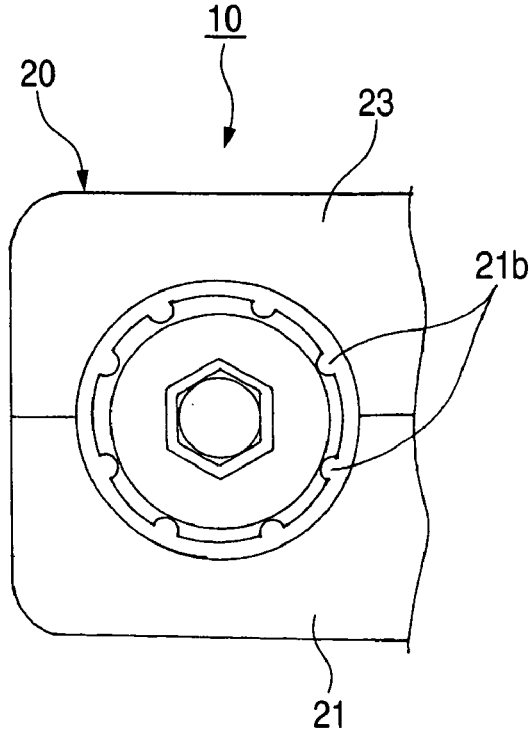
FIG. 9 is a view as seen in a direction of arrow C of FIG. 8.
Figure 10:
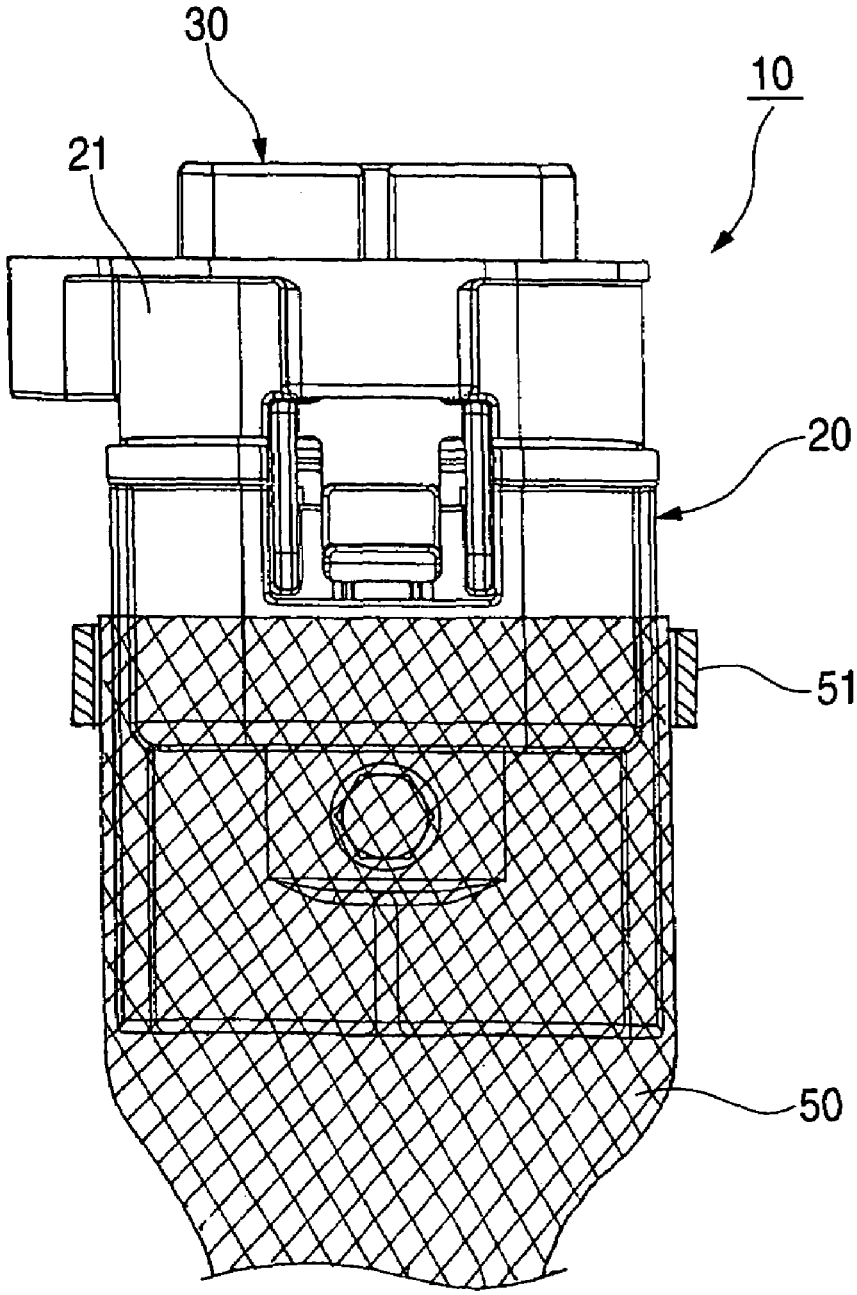
FIG. 10 is a plan view showing a condition in which the wire harness-side shield connector of FIG. 3 is applied to a collective shield structure.
Figure 11:
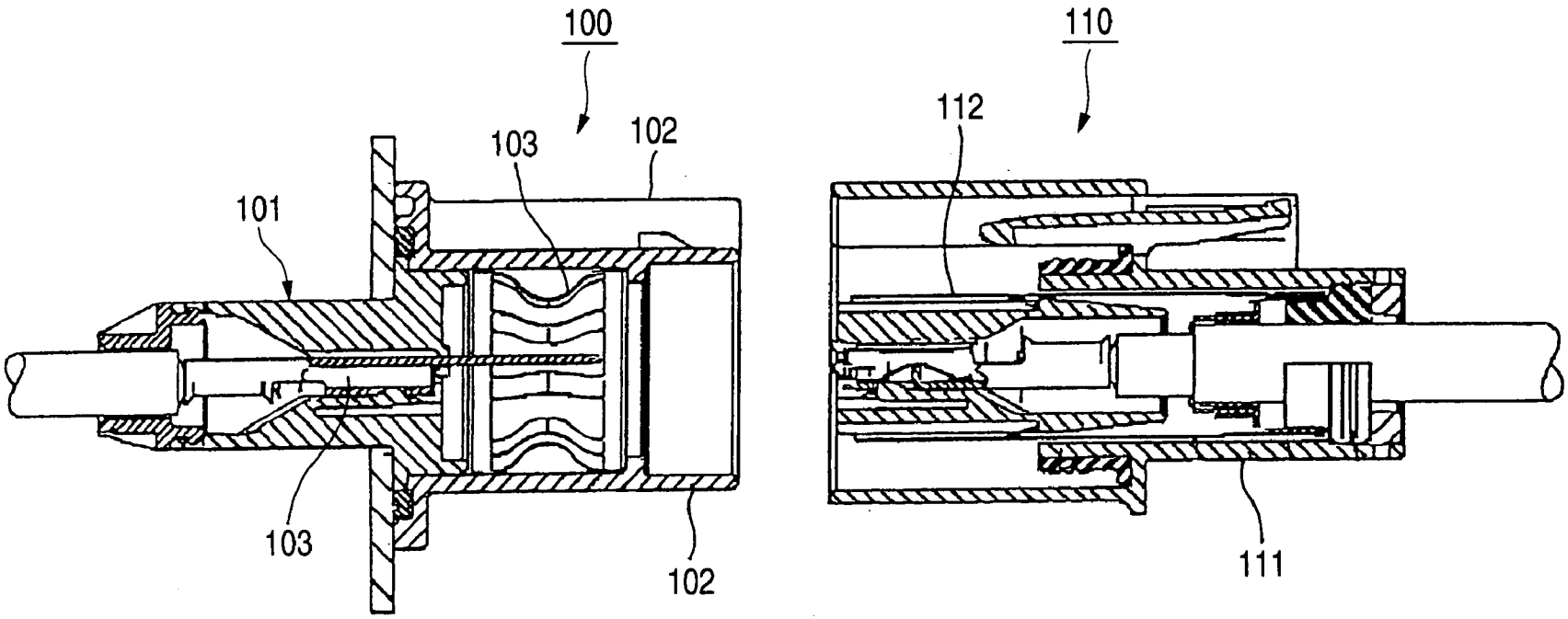
FIG. 11 is a longitudinal cross-sectional view of a shield connector disclosed in Patent Literature 1.

FIG. 1 is a plan view of a shield connector structure employing one preferred embodiment of a wire harness-side shield connector of the invention, FIG. 2 is an exploded, perspective view of the wire harness-side shield connector of the shield connector structure of FIG. 1, FIG. 3 is a plan view of the wire harness-side shield connector of the shield connector structure of FIG. 1, FIG. 4 is a side-elevational view of the wire harness-side shield connector of FIG. 3, and FIG. 5 is a perspective view of the wire harness-side shield connector of FIG. 3. FIG. 6 is a front-elevational view of the wire harness-side shield connector of FIG. 3 as seen from the upper side of FIG. 3, FIG. 7 is a cross-sectional view taken along the line A-A of FIG. 6, FIG. 8 is a cross-sectional view taken along the line B-B of FIG. 6, and FIG. 9 is a view as seen in a direction of arrow C of FIG. 8. FIG. 10 is a plan view showing a condition in which the wire harness-side shield connector of FIG. 3 is applied to a collective shield structure.

As shown in FIG. 1, an inverter unit-side connector 1 comprises a resin-molded housing 2, an electrically-conductive body 3, and an electrically-conductive cover 4 generally grippingly mounted on the electrically-conductive body 3. This inserter unit-side connector 1 is directly mounted on an inverter unit (not shown). The wire harness-side shield connector 10 is fitted to the inverter unit-side connector 1.

As shown in FIGS. 2 to 8, the wire harness-side shield connector 10 comprises an outer case 20 which has a shielding function and can be fittingly connected to the inverter unit-side connector 1, and a housing 30 which receives connection terminals (female terminals) 31 (see FIG. 7).

As shown in FIG. 2, the outer case 20 comprises a shield shell 21 having a shielding function for shielding electromagnetic waves and for effecting a grounding connection, and a shell holder 23 fixed to the shield shell 21 by threading a screw member 22.

The housing 30 is engaged in the shield shell 21 of the outer case 20. The housing 30 receives the plurality of connection terminals 31 fixed by press-clamping respectively to a plurality of shielded wires 40, and holds and insulates the connection terminals 31 (see FIG. 7).

When the wire harness-side shield connector 10 is fittingly connected to the inverter unit-side connector 1, a contact surface 21*a* of the shield shell 21 of the outer case 20 is held against a contact surface 3*a* of the electrically-conductive body 3 of the inverter unit-side connector 1, thereby positively effecting the grounding for shielding purposes.

A braid 41 of each shielded wire 40 is folded back outwardly in the vicinity of a rear end portion (lower end portion in FIG. 7) of the shield shell 21, and a shield terminal 42 is fixed by press-clamping to an outer periphery of the thus folded-back braid 41, and therefore is conductively (or electrically) connected to the braid 41, as shown in FIG. 7.

When the shell holder 23 is fixed to the shield shell 21, each of the shield terminals 42 causes the braid 41 of the corresponding shielded wire 40 to be grounded with the shield shell 21. Namely, when the shell holder 23 is fixed to the shield shell 21 by threading the screw member 22, a peripheral surface 42*a* of each shield terminal 42 is held by the shell holder 23 together with projections 21*b* (see FIG. 9) formed on an inner surface of the shield shell 21. The braid 41 of each shielded wire 40 is conductively connected to the shield shell 21 by an axial force of the threaded screw member 22, and therefore is grounded with this shield shell 21.

In the case of connecting a collective shield braid 50 to the wire harness-side shield connector 10, a shield ring 51 is mounted on the shield shell 21 as shown in FIG. 10. Namely, the collective shield braid 50 is fitted on the shield shell 21, and in this condition the shield ring 51 is fitted on the collective shield braid 50, thereby press-fastening the collective shield braid 50 to the shield shell 21.

An annular waterproof packing 32 is fitted on an outer periphery of a fitting-side front end portion (upper end portion in FIG. 7) of the housing 30. The waterproof packing 32 is interposed between the housing 30 and the shield shell 21, and forms a waterproof seal between the outer peripheral surface of the housing 30 and the inner peripheral surface of the shield shell 21.

An annular waterproof plug 33 is fitted on the outer periphery of each shielded wire 40, and is disposed between the connection terminal 31 and the shield terminal 42. Each of the waterproof plugs 33 is interposed between the corresponding shielded wire 40 and the housing 30, and forms a waterproof seal between the outer peripheral surface of the shielded wire 40 and an inner surface of the housing 30. Thanks to the provision of the waterproof packing 32 and the waterproof plugs 33, the waterproof ability of the front end portion of the wire harness-side shield connector 10 is secured.

In this wire harness-side shield connector 10, the shell holder 23 is fixed to the shield shell 21 by threading the screw member 22, and the braids 41 of the shielded wires 40 are conductively connected via the respective shield terminals 42 to the shield shell 21 by an axial force of the screw member 22. As a result, the braids 41 of the shielded wires 40 are grounded with the shield shell 21 via the respective shield terminals 42, and thus are subjected to individual (or separate) shield processings, respectively.

In the case of effecting the collective shield processing as shown in FIG. 10, the collective shield braid 50 is fitted on the shield shell 21 of the wire harness-side shield connector 10, and in this condition the shield ring 51 is further fitted on the braid 50, thereby press-fastening the braid 50 to the shield shell 21. As a result, the shield shell 21 and the collective shield braid 50 are conductively connected together, thus effecting the collective shield processing.

As described above, the wire harness-side shield connector 10 of the above embodiment has the housing 30 (which receives the connection terminals 31) at the inverter unit-side connector (1)-connecting side (upper side in FIG. 1), and the waterproofing of the housing 30 is secured by the waterproof packing 32 and the waterproof plugs 33. Also, the shielding connection of the shielded wires 40 is secured by the outer case 20 comprising the shield shell 21 and the shell holder 23.

Namely, the wire harness-side shield connector 10 comprises the outer case 20 including the shield shell 21 and the shell holder 23, and the housing 30 which is provided within the shield shell 21 of the outer case 20 and receives the connection terminals 31 fixed by press-clamping respectively to the end portions of the shielded wires 40. When the shell holder 23 is fixed to the shield shell 21, each of the shield terminals 42, fixedly mounted on the outer periphery of the braid 41 of the corresponding shielded wire 40 in conductively-connected relation thereto, causes the braid 41 of the shielded wire 40 to be grounded with the shield shell 21. Further, the waterproof packing 32 is fitted on the outer periphery of the fitting-side front end portion (upper end portion in FIG. 7) of the housing 30, and the waterproof plug 33 is fitted on the outer periphery of the portion of each shielded wire 40 disposed between the connection terminal 31 and the shield terminal 42.

Therefore, the wire harness-side shield connector of the invention can easily and positively cope with the difference in the electromagnetic shield processing (individual shield processing or collective shield processing) from one vehicle to another, without the need for providing a shield portion at the inverter unit-side connector 1.

The wire harness-side shield connector of the invention is compatible with different types of electromagnetic shield processings (individual shield processing and collective shield processing), and can be suitably used in the case where the different types of electromagnetic shield processings are required in different kinds of vehicles.

What is claimed is:

1. A wire harness-side shield connector, comprising:

an outer case, fittingly connected to a unit-side connector and having a shielding function; and a housing, receiving connection terminals fixed respectively to end portions of a plurality of shielded wires;

wherein said outer case comprises:

a shield shell which receives said housing and has a shielding function; and a shell holder which when fixed to said shield shell by threading a screw member, causes braids of said shielded wires folded back outwardly, to be conductively connected to said shield shell, wherein a shield ring is mounted on said shield shell of said wire harness-side shield connector when connecting a collective shield braid to said shield shell; and said collective shield braid is fitted on said shield shell, and then said shield ring is fitted on said collective shield ring, thereby press-fastening said collective shield ring to said shield shell.

2. The wire harness-side shield connector according to claim 1, wherein shield terminals are fixed respectively to outer peripheries of said folded-back braids of said shielded wires in such a manner that said shield terminals are conductively connected respectively to said braids; and when said shell holder is fixed to said shield shell by threading said screw member, said braids of said shielded wires are grounded with said shield shell via the respective shield terminals.

3. The wire harness-side shield connector according to claim 1, wherein a waterproof packing is fitted on an outer periphery of said housing, and is interposed between said housing and said shield shell, and a waterproof plug is fitted on an outer periphery of that portion of each shielded wire disposed between said connection terminal and said shield terminal, and is interposed between said shielded wire and said housing.

* * * * *